United States Patent [19]

Krüger et al.

[11] 4,260,452

[45] Apr. 7, 1981

[54] PRODUCTION OF PAPER PULP FROM SUGAR MILL BAGASSE

[76] Inventors: Horst Krüger, Martinstr. 42, 61 Darmstadt; Wilhelm Berndt, Bertha-v.Suttner-Ring 11a, 6 Frankfurt am Main; Ursula Schwartzkopff, Hörsteiner Str. 13, 8752 Kleinostheim; Franz J. Reitter, Grovestr. 13, 8 Munich 50; Theodor Höpner, Harlinger Str. 6, 29 Oldenburg in Oldenburg; Hans-Joachim Mühlig, Aschaffstr. 48, 875 Aschaffenburg, all of Fed. Rep. of Germany

[21] Appl. No.: 963,706

[22] Filed: Nov. 24, 1978 (Under 37 CFR 1.47)

Related U.S. Application Data

[63] Continuation-in-part of Ser. No. 884,513, Mar. 8, 1978, abandoned, which is a continuation of Ser. No. 685,326, May 11, 1976, abandoned.

[51] Int. Cl.[3] ..... D21C 1/00; D21C 3/00; D21C 3/04

[52] U.S. Cl. ..... 162/23; 162/24; 162/25; 162/26; 162/28; 162/72; 162/76; 162/78; 162/80; 162/84; 162/86; 162/88; 162/90; 162/96; 162/DIG. 12; 435/278

[58] Field of Search ..... 162/23, 24, 25, 26, 162/28, 55, 72, 76, 78, 80, 84, 86, 90, 96, DIG. 12, 87, 88, 89; 8/111; 21/2, 58; 195/8, 9, 10, 11; 241/17, 21, 23, 24, 25, 28; 252/380; 435/277, 278, 279, 280; 422/28, 32, 37, 40

[56] References Cited

U.S. PATENT DOCUMENTS

| | | | |
|---|---|---|---|
| 2,899,350 | 8/1959 | Birdseye | 162/96 X |
| 2,924,547 | 2/1960 | Knapp et al. | 162/96 X |
| 2,960,444 | 11/1960 | Ritter | 195/8 |
| 3,013,931 | 12/1961 | Wethern et al. | 162/96 X |
| 3,238,088 | 3/1966 | Villavicencio et al. | 162/96 X |
| 3,666,620 | 5/1972 | Wright | 162/96 X |
| 3,832,278 | 8/1974 | Villavicencio | 162/96 X |

FOREIGN PATENT DOCUMENTS

| | | | |
|---|---|---|---|
| 247981 | 9/1960 | Australia | 162/96 |

OTHER PUBLICATIONS

Atchison (I), "Modern Methods of Purchasing, Handling, Storage & Preservation of Bagasse–Major Advances in the Sixties", TAPPI Non–Wood Plant Fibers Committee, Oct. 25, 1971.

Atchison, "Rapid Continuous Methods For Depithing & Pulping Bagasse", Paper Trade Journal, 8-26-57, pp. 36–42; 162–196.

*Primary Examiner*—Arthur L. Corbin

*Attorney, Agent, or Firm*—Millen & White

[57] ABSTRACT

Paper pulp is produced by a process in which raw sugar mill bagasse is moist depithed, wet bulk stored in the presence of an inorganic and organic preservative, wet depithed by hydraulic shearing in the presence of an inorganic color remover, pulped, washed, cleaned and dewatered.

15 Claims, No Drawings

PRODUCTION OF PAPER PULP FROM SUGAR MILL BAGASSE

CROSS-REFERENCE TO RELATED APPLICATIONS

This application is a continuation-in-part application of U.S. application Ser. No. 884,513, filed on Mar. 8, 1978, now abandoned, which is a continuation application of U.S. application Ser. No. 685,326, filed on May 11, 1976, now abandoned.

BACKGROUND OF THE INVENTION

This invention relates to a method of recovering paper pulp from sugar cane bagasse, to the paper pulp so obtained and to newsprint made therefrom.

Due to steadily rising standards of living in all countries, the production of pulp and paper from sugar cane bagasse is of increasing importance, especially in countries with limited pulp wood resources and considerable sugar cane cultivation, so bagasse is, for practical purposes, the sole source of fibrous raw material.

In view of the growing desire of people for information, the possibility of producing newsprint paper from sugar cane bagasse is of extraordinary importance in those countries.

Since newsprint paper is a high volume product, low production and finishing costs are primary considerations. The development of technology is such that newsprint paper can be produced economically and efficiently only using modern big paper machines which operate at very high speeds.

Newsprint paper is usually produced exclusively from mechanical pulp made from soft wood to which is added certain amounts of chemical pulp. Due to its high yield, mechanical wood pulp can be produced at low unit production cost. The addition of chemical pulp results in suitable strength properties and runability. Usually, unbleached sulphite or bisulfite pulp grades, semi-bleached sulfate pulp, etc., are used. Other pulp types, e.g., chemiground wood or semi-chemical high-yield pulps, are used only in a few paper mills.

Raw materials used for production of newsprint paper have to be of a specified quality. When one component has to be substituted for another pulp grade due to material shortage or high price, the substitute should be of proper quality for processing with modern machines. These properties include runability on the paper machine and on different printing machines as well as quality of the paper and the printing. Thus, a substitute fibrous material must not cause any difficulties in sophisticated modern production methods.

The quality of fibrous materials for newsprint paper production is usually tested by measuring certain physical properties, e.g., dewatering properties, mechanical strength at certain freeness, breaking length, tensile, tearing strength and folding endurance. For newsprint paper, initial wet strength is of decisive importance. This property relates to the behavior of the wet web at the transition from the press section to the dryer section of the paper machine. Other properties taken into consideration include runability on the paper machine, e.g., sticking of the wet paper web to the press rolls. Furthermore, brightness and opacity of the pulp are of great importance.

A conventional pulp mixture suitable as newsprint furnish, consisting of about 80% mechanical pulp from spruce and 20% bleached chemical pulp from spruce or pine wood, has the following test values at a freeness of 30°–40° Schopper-Riegler

| | |
|---|---|
| breaking length: | 3000–5000 m. |
| initial wet strength: | 30–60 g. (medium quality) |
| | 60–80 g. (good quality) |
| | 80–100 g. (superior quality) |

According to present technology, the above-given properties are required for a pulp furnish processed at paper machine speeds up to 1000 m./min. at a weight of about 55 g./m.$^2$.

Test values of the finished newsprint paper are slightly different from the values of the pulp raw material. Typical data for newsprint paper are in the following range:

| | |
|---|---|
| brightness | 67 to 60% MgO (Elrepho) |
| density | 0.5 to 0.6 g./cm$^3$. |
| breaking length | 2500 to 4500 m. |
| tear | 30–60 cmp./cm. |
| bursting strength | 1.0–1.5 kp./cm$^2$. |

The final criteria of suitability of newsprint paper are mainly runability in the printing machine and printing quality. Normally, paper is passed through the printing machine at a velocity of about 8–10 m./sec. Tear is of primary importance, since rupture of the paper is caused by lateral defects of the paper web. Pulp produced from sugar cane bagasse has to meet all requirements above to be suitable for newsprint production.

Pulp of sugar cane bagasse has been produced for several years on a commercial basis (see: Atchison "Utilization of Sugar Cane Bagasse in the Pulp and Paper Industry", Paper Trade Journal, 1952). The procedure used is similar to the pulping of wood. A special feature of the raw material preparation is the depithing operation, because the pith in the sugar cane stalk is unsuitable for pulp production.

Pulp produced from the bagasse fiber fraction has been used successfully for the production of different paper grades, e.g., in bleached pulp for the production of medium-fine and fine writing and printing papers.

Although scientists had concluded that the morphological structure of the sugar cane stalk under proper conditions should result in a fiber product suitable for newsprint paper furnish, the production of newsprint paper from 100% bagasse fibers on a commercial basis has been unsuccessful. (See: Pulp and Paper Int., June 1972, page 70).

Numerous efforts and test runs have been carried out by different companies. Tetlow describes a process (Pulp and Paper Int., May 1972, page 58), commonly known as the Cusi Process. Another procedure called Peadco-Villavicencio Process is described in Pulp and Paper Int., January 1972, pages 41 & 42.

Both of these processes were developed by intensive work based on precise knowledge of the production technology for bagasse pulp for fine papers. However, a fibrous material suitable for the production of newsprint paper on 100% bagasse basis could not be obtained.

The Peadco-Villavicencio Process (Tappi CA Report Nr. 40, 1971, pages 137 ff) consists essentially of the following steps:

(a) Bagasse storage by any known method;

(b) two-stage depithing, consisting of moist depithing and wet cleaning;

(c) prehydrolysis with water at 8.5 atm. and 175° C.;

(d) digestion at pH 8 using 1% sodium silicate and 2% sodium bisulfite at 175° C.; and (e) washing, screening, cleaning and concentrating by any known method.

There is no bleaching step. Sodium silicate added during digestion is alleged to act as oxidizing agent. Yields of 80%, calculated on bone-dry depithed bagasse fiber, are claimed.

The Cusi Process consists of:

(a) Bagasse storage, not specified; drying of bagasse is optional;

(b) depithing;

(c) two-step digestion consisting of an impregnation step and a cooking step with mild pulping conditions;

(d) classification of pulp fibers into two fractions;

(e) severe mechanical treatment of the fiber fraction of lower pulping degree and subsequent re-mixing with the fiber fraction of higher pulping degree; and (f) intensive bleaching with 10% sodium hypochlorite.

Disadvantages of the two processes above include:

(a) Both known processes employ two-stage digestion, which requires a considerable capital investment for digestion apparatus.

(b) Prehydrolysis by the Peadco Process is carried out under uncontrolled conditions and may lead to varying results depending on random parameters.

(c) The alleged oxidation of lignin by the sodium silicate in the Peadco Process is not in agreement with well established chemical theories.

(d) All plant trials for the production of newsprint by the Peadco Process have failed.

(e) The Cusi Process produces fairly dark pulps which have to be subjected to intensive bleaching. High material losses and problems with the disposal of chlorine-containing bleaching effluents result. Because dissolution of organic material occurs in the bleaching rather than in the cooking stage, recovery of chemicals from the spent cooking liquor is impractical and uneconomical.

(f) A low pulp yield is obtained, which may be 15% lower than by the process of the present nvention, by the Cusi Process.

(g) Mechanical pulp strength is insufficient by either the Cusi or Peadco Process. Breaking lengths obtainable vary between 3000 and 5000 m.; tearing strength is between 30 and 70 cmp./cm.

(h) Reports in the scientific literature (Pulp and Paper International, January, 1972, pages 41 ff) indicate that neither the Cusi nor the Peadco Process permits production of newsprint from 100% bagasse fiber. In both cases considerable amounts, of the order of 15%, of chemical long-fiber pulp had to be added.

Test runs in commercial pulp plants have shown that bagasse pulp provides a substitute for the mechanical wood pulp in the newsprint furnish, but 5–15% of high-grade chemical pulp had to be added. The ultimate aim is production of a bagasse pulp having qualities which allow production of newsprint paper from bagasse pulp only. This is of particular importance to areas having limited wood resources.

In producing pulp suitable as the sole raw material for newsprint paper utmost care should be taken that all favorable properties characteristic of the sugar cane stalk are conserved as completely as possible. Commonly known processing methods damage the bagasse fibers in the initial processing steps, storage and depithing, as well as in the pulping and the bleaching processes.

Due to a residual sugar content of about 2%, the bagasse is exposed to bacterial decomposition during transport and storage under moist conditions, resulting in decreased fiber strength. Bacterial attack can be reduced by addition of black liquor, addition of propionic acid, or by drying raw bagasse prior to storage. However, fiber damage was not completely eliminated, whether caused by bacterial attack or by hornification during drying.

Unsuitable storage conditions can initiate the formation of greyish-green to intensive brown components which resist bleaching under normal cooking and bleaching conditions. In these cases, the pulp can be bleached only by use of a drastic, expensive bleaching process.

Before pulping, pith, which decreases strength properties and increases chemical consumption in the cooking stage, should be removed as completely as possible. Removal of pith is not necessary to this high degree for some other pulp grades. Since pith cells cling firmly to the fiber, mechanical energy has to be applied to separate them and may result in mechanical damage of fibers. Therefore, optimum conditions for depithing have to be developed.

Owing to heterogeneity and varying density over the cane stalk profile, bagasse fiber bundles are attached more or less by the mechanical depithing procedure and the chemical pulping reaction. The varying density of the fiber system of sugar cane is the basis for producing pulps having a spectrum of degrees of pulping, similar to conventional newsprint furnish consisting of mechanical and chemical wood pulp.

Thus, a pulping procedure mild enough to retain the specific characteristics of the different fractions should be used. Highly alkaline solutions may cause stabilization of deeply colored complexes which cannot be bleached by a mild one-step bleaching process.

Thus, there is a continuing need for a process in which the initial brightness of the bagasse fibers during raw material preparation, storage and cooking is preserved in the unbleached pulp in order to obtain a bright ready stock by a mild bleaching procedure.

The objects of the present invention are:

(a) to provide improved bagasse paper pulp, especially of such properties that it may be used as the sole fiber component for the production of newsprint.

(b) to provide a process by which a bagasse pulp suitable as sole fiber component for the production of newsprint paper may be manufactured;

(c) to provide a process in which bagasse fibers are not subjected to deterioration by irreversible hornification caused by drying;

(d) to provide a process in which attack of the bagasse by bacteria during storage is avoided, i.e., in which bacterial degradation and, hence, loss of strength are avoided;

(e) to provide a process in which brightness losses and coloration of bagasse fiber, and formation of more or less insoluble colored complexes are avoided during storage and pulping operations;

(f) to provide a process including pulping conditions of high specific selectivity for bagasse fiber while retaining or improving the original brightness of the fiber component;

(g) to provide a process in which the inherent strength properties of bagasse fiber after pulping are retained during bleaching;

(h) to provide a process with reduced loss of fibrous material during processing of bagasse fibers;

(i) to provide a process which causes a minimum loss of inherent opacity of bagasse fiber;

(j) to provide a process in which the yield of bagasse is increased and the strength value is increased; and (k) to provide a process which reduces the overall quanity of chemicals required, e.g., in the bleaching step, since the usual green/brown coloration appearing during storage is reduced, whereby a brighter unbleached pulp is obtained.

Upon further study of the specification and appended claims, further objects and advantages of this invention will become apparent to those skilled in the art.

SUMMARY OF THE INVENTION

These objects have been achieved by providing in a process for the production of paper pulp from sugar mill bagasse which comprises wet bulk storing partially depithed bagasse, the imrovement which comprises treating the partially depithed bagasse in wet bulk storage with an amount of (a) a $C_{1-5}$-aliphatic acid, (b) a $C_{1-6}$ hydroxy acid, (c) an alkali metal or Al salt of (a) or (b), or (d) an amide of (a) or (b), as a preservative effective to preserve the partially depithed bagasse.

The objects of the present invention have also been achieved by a preferred sequence of process steps, the combination of which effects chemical and morphological benefits leading to unexpectedly and particularly good results obtainable by this invention. This process comprises one or more, and preferably all, of the following steps:

(a) moist depithing raw sugar mill bagasse to remove up to about 66% of the pith content;

(b) wet bulk storing said depithed bagasse with addition of aliphatic acids, substituted or unsubstituted, of hydroxy acids and/or of amides or salts of such acids, in order to preserve the bagasse from bacterial degradation and reduce undesired coloring;

(c) wet depithing an aqueous suspension of the stored depithed bagasse by hydraulic shearing;

(d) pulping the web depithed bagasse of step (c) by a neutral sulfite semi-chemical process or any similar fiber preserving process as for example thermo-mechanical pulping (TMP);

(e) mechanically pulping the product of step (d), preferably by hot refining in a double-disc refiner;

(f) washing, screening, cleaning and dewatering the pulp produced in step (e); and (g) bleaching the pulp of step (f), preferably with hydrogen peroxide in the presence of NaOH and optionally a stabilizer.

In one product aspect, this invention relates to paper pulp suitable as the sole pulp furnish for newsprint, obtained from sugar mill bagasse by the above processes.

In another product aspect, this invention relates to newspring obtained from pulp furnish obtained from sugar mill bagasse, as above.

DETAILED DESCRIPTION

Bagasse is the fibrous portion of the sugar cane from which juice is extracted. As discharged from the milling train, it contains solid matter, mostly short fibers and spongy tissue of the pith and, generally, about 50% by weight of water.

Sugar cane belongs to the genus Saccharum, of which the three basic species are *S. officinarum, S. robustum* and *S. spontaneum* and varieties thereof. Bagasse from any of the foregoing species can be used, but bagasse from *S. officinarum* is preferred.

Sugar cane is grown on a commercial scale mainly in Southeastern Asia, Indonesia, the Philippines, Malay, Indo-China, Eastern India, Persia, Egypt, the West Indies and Central America. For the practice of this invention, bagasse derived from cane grown in Northern areas of South America and southern areas of North America is equally useful.

During the inventive wet bulk storage of the bagasse, e.g., step (b) of the aforementioned preferred process, the following chemicals, i.e., organic acids, salts thereof or amides thereof, or mixtures thereof can be added to the storage medium, whereby the fiber is protected from bacterial degradation, the pulp yield increases, the pulp strength increases and the degree of coloration (usually green and brown) during storage is reduced, thereby producing a brighter unbleached pulp and achieving a decrease in the quantity of chemicals needed in subseqent steps, particularly the bleaching step:

(a) aliphatic acids, preferably of 1-5 carbon atoms; but higher carbon atom contents are also suitable. These acids are saturated hydrocarbon carboxylic acids, preferably monobasic, e.g., acetic acid. Propionic acid is preferred. However, dibasic acids are also suitable such as oxalic, succinic, malonic acid, etc.

(b) substituted aliphatic acids mentioned in (a) which are equivalent to acids (a), e.g., acids (a) substituted by amino groups, substituted amino groups, halogens, sulfur compounds, etc.

(c) hydroxy acids, preferably of 1-6 carbon atoms; but higher carbon atom contents are also suitable. The acids are mono and polybasic aliphatic acids substituted by one or more OH groups. Suitable acids include lactic acid, citric acid, tartaric acid, tartronic acid, etc.

(d) salts of (a)-(c) such as alkali metal salts (Na, K etc.), aluminum salts, aluminum phosphate salts, such as, monosodium maleinate, disodium citrate, aluminum triacetate, aluminum monoacetate phosphate, etc. Polyphosphates, sulfites, chlorites and hypochlorites are also suitable.

(e) amides of (a)-(c).

Generally, 0.01-0.3 grams of the foregoing chemicals/liter of bulk storage volume are employed. Preferably such chemicals include lactic acid, propionic acid and propionic acid amide. However, for the chemicals in the category (d), from 0.1-2.0 parts per 100 parts of bagasse should be used. The addition of any of these chemicals can be made prior to or during storage and can be carried out either continuously or discontinuously.

Typically, by employing the chemical additions of this invention, pulp yield increases of 4-5% and strength increases, as conventionally measured, of 10-20%, are obtained.

In the wet bulk storage step, the preferably partially depithed bagasse will constitute 15-25% of the wet mixture, preferably 19-21%, with most of the balance being water.

The chemical treatment during storage of this invention can be combined with the conventional preservation and/or prehydrolysis treatment using microbial cultures. Typical of wet bulk storage of this kind is the Ritter Process set forth in British Pat. Nos. 497,960 and 497,982 and U.S. Pat. No. 2,960,444, incorporated herewith by reference. This process uses acid-producing bacteria cultures such as Propionibacterium, Acetobacter, Species of Aspergillus Lactobacillus. However, lactic acid producing bacteria, especially *Lactobacillus caucasicus, L. lactis, L. helveticus, L. bulgarius, L. thermophilus, L. fermenti, L. brevis* and *L. pastorianus* are preferred.

The bacterial cultures consume the residual sugars and simultaneously form organic acids. This results in decreasing the development of other harmful microbial cultures and the resulting acid phase causes a mild prehydrolytic action on bagasse and decomposition of naturally-occurring colors. The Ritter Process at this stage therefore has the following advantages: preservation of bagasse, decreased losses during storage, increased brightness, loosening of pith from the fiber bundles and mild prehydrolysis of low-molecular weight carbohydrates.

The period of wet bulk storage can vary from 2 to 18 months, but preferably is from 4 to 12 months. Typical storage conditions are set forth at 6 months.

The beneficial effects of the foregoing chemical additions during the web bulk storage step is enhanced by further addition of an amount effective to preserve the pulp, e.g., 10–20 g of one or a mixture of the following chemicals per liter of storage volume: carbonates, phosphates, polyphosphates, sulfites, chlorites, hypochlorites etc. of alkali metals (Na, K, etc.), magnesium, calcium and aluminum.

Because a considerable amount of residual sugar adheres to the pith cells, an initial fully conventional moist depithing prior to storage results in a considerable decrease of sugar content and in lower bacterial damage during storage. This is the step (a) of the aforementioned preferred process. Lower amounts of chemicals than heretofore are used for preservation and bleaching.

Moist depithing as opposed by dry depithing, as the first production step, avoids damage to fibers due to the elastic condition of the moist fiber. In one embodiment, 33–66% of the pith is removed in moist depithing step (a). It is preferred to remove from 50% up to about 66% of the original pith content by moist depithing. More intensive depithing may affect the fiber quality adversely and should be avoided. Moist depithing is carried out by use of known machines, such as hammer mills. Conditions for moist depithing include a temperature determined by sugar mill conditions, i.e., about 10°–40° C. and a ratio of bagasse of water of 2:1 to 1:1.

The subsequent step of wet cleaning or wet depithing of bagasse (step c of the aforementioned preferred process) is carried out on a subsequently formed aqueous suspension of the stored, partially depithed bagasse by applying hydraulic shear, in order to remove up to 80%, preferably 60%, of the residual pith. Conventional pulper-type depithing machines can be used, the bagasse being diluted to about 1:5 up to 1:10 by weight. According to the invention, the fibers are kept moist during the preceding steps, so that the remainder of the pith, already loosened from the fibers by the reaction during moist storage, can be removed easily and without any deterioration of the elastic moist fibers.

A special feature of the process of the present invention is the use of chemicals during wet depithing to remove colored substances and other undesirable matter, including dirt and dust. Such chemicals include carbonates, sulfites, hydroxides, phosphates and polyphosphates, sulfites, chlorites, hypochlorites etc. of alkali metals (Na, K, etc.), magnesium, calcium and aluminum. Sodium carbonate and sodium polyphosphate are preferred. The amount of chemicals added is from 0.5 to 10 parts per 100 parts of suspension, preferably from 1 to 3 parts.

Pulping can be done by a semi-chemical method, in which the fibrous bagasse is given mild chemical pretreatment before mechanical defibration, or by thermomechanical pulping. In the semi-chemical pulping, cooking with neutral sulfite, caustic soda, (lime solutions) is generally employed. Chemicals as above, can be added prior to refining in a conventional double disc refiner.

In thermomechanical pulping, fibers are given a steaming or other heat treatment before or during defibering in a disc mill. Steaming or heating in hot water softens the fibers so that pulp produced by grinding has fewer broken fibers and fewer coarse fiber bundles than otherwise. A typical steaming period is about 3 minutes at 2 kg/cm$^2$. The steamed fibers are defibered in a disc-type attrition mill, similar to those used for refining ground wood, consisting of two discs, made of special alloys, one or both of which rotates.

Pulping is preferably carried out by the neutral sulfite semi-chemical (NSSC) process, using sodium carbonate or bicarbonate as a buffer. Continuous digesters or batch degested of conventional type can be used. A liquor to fiber ratio as high as possible, preferably from 2:1 to 4:1, is recommended. In the NSSC process, the level of sulfite is from 50 to 200 g./liter, preferably 70 to 100 g./liter. A temperature of 140°–185° C. is usable, preferably 160°–180° C.

The heating period can be varied from 2 min to 60 minutes, but preferably is 10 to 20 minutes. An especially preferred set of conditions is:

liquor-to-fiber ratio: 1.2
concentration: 80 g/l $Na_2SO_3$
cooking time: 12–15 min at 170°–175° C.

For information on NSSC, see, generally, Sven A. Rydholm: Pulping Processes, Interscience Publishers, New York 1965.

Continuous pulping by a horizontal tube digester equipped with screw conveyor can, for example, be carried out under the following conditions:

Pulping chemical: 14% $Na_2SO_3$ and 4% $Na_2CO_3$ calculated on b.d. depithed bagasse, the cooking liquor concentration being 160 g./l. $Na_2SO_3$ and 50 g./l. $Na_2CO_3$.

Cooking conditions: 20 minutes retention at T max of 170°–175° C.

Extractive or dispersing chemicals such as polyphosphates can be added during the pulping step in order to remove coloring substances, resins, waxes, etc. Polyphosphates, such as alklali salts of linear condensated phosphoric acid are preferred at a concentration of 1–3 parts per 100 parts of fiber slurry.

The process of this invention can be integrated with a chemical recovery plant if economic and environmental conditions require. The material balance of the process guarantees that the maximum amount of organic substances are in the black liquor from the pulping plant and that the bleaching effluents are essentially free of BOD load.

The pulping procedure is carried out up to a pulping degree which does not lead to spontaneous defibration, that is, pulping to an extent corresponding to a Kappa number of 25–30. A mechanical defibration stage is used subsequently. This is preferably carried out in a conventional double-disc refiner. Hot refining is preferred, especially from 90° to 120° C.

The further processing of the unbleached pulp, i.e., washing, screening, cleaning and dewatering, is conventional. In general, but not in all cases necessarily, the pulp obtained is subjected to a bleaching step.

Bleaching, if required, is carried out with hydrogen peroxide with addition of a certain quantity of NaOH. Stabilizers may be added. An amount of 0.5–10% hydrogen peroxide (100% weight), preferably 1–5% hydrogen peroxide should be used. The quantity of NaOH necessary depends on the kappa number of the unbleached pulp and is preferably between 1 and 5%. With pulps containing substantial quantities of ions of heavy metals (copper, iron, manganese, cobalt etc.) the addition of a peroxide stabilizer is necessary. Suitable stabilizers are sodium silicate (1–10%, preferably 1–5%) or other substances forming stable complexes with heavy metal ions.

Typical stabilizers are polyaminocarbonic acids and their alkali salts, such as ethylenediamine tetraacetic acid, diethylene triamine pentaacetic acid, nitrilo-triacetic acid: polyoxycarbonic acids, such as gluconic acid, tartaric acid, citric acid, and polymeric oxycarbonic acids. The complex-forming substances are employed in an amount of 0.05–1%. All data given above are for absolutely dry pulp.

The peroxide bleaching process is advantageous in view of effluent disposal problems, since only a very small organic fraction is dissolved during the bleaching reaction and a low BOD effluent results. Since only one bleaching step is required, considerable savings in investment for machines, pumps, etc. can be achieved.

The process of this invention, including the variationsin conditions, chemical additives, etc., set forth provides a feasible method of producing newsprint-grade pulp from bagasse.

The combination of moist depithing, wet bulk storage and wet cleaning assures that the fibrous material is never dried until the pulping stage. Thus, deterioration by hornification caused by drying is avoided. Wet depithing prior to storage whereby depithing is carried out only to such an extent that no mechanical effect on the fibers can be observed, reduces the danger of bacterial damage. Wet bulk storage by Ritter Process achieves preservation of the bagasse, loosening of pith left by the first depithing stage, avoidance of the formation of colored complexes and initiation of a mild prehydrolysis reaction. In the wet cleaning stage, residual pith, loosened during storage, fines and solubles are removed.

The mild selectivity of the NSSC pulping process result in optimum yield and properties of the fiber derived from bagasse raw material. As described above, the final peroxide bleaching step can have optimum efficiency if the formation of coloring and resistant components is avoided during the eariler steps. The peroxide bleaching process results is optimum yield and fiber quality, which cannot be achieved by conventional chlorine or hypochlorite bleaching. Moreover, the stability of brightness and initial wet strength of the moist pulp is increased.

A further important economic advantage of this process is ease of chemical recovery, since nearly all of the organic substances are dissolved in the black liquor, which is introduced into a recovery cycle. The technique of NSSC recovery is well developed. Moreover, the final yield of bleached pulp is, especially in view of the good fiber quality achieved, relatively high, thus leading to optimum raw material utilization and optimum economy.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. It is further to be understood that each step of the process is valuable per se inasmuch as it leads to improved bagasse pulp.

COMPARATIVE EXAMPLE

Bagasse of about 50% moisture content coming from the sugar mill from sugar extracted from *S. officinarum,* grown in Egypt, is exposed to moist depithing. Less than about 66% of the original pith content should be removed to avoid mechanical damage to the fiber. The depithed bagasse is thoroughly mixed with Ritter biological solution by means of a mixer. The bagasse is conveyed to the storage yard and is stored by the special Ritter procedure as set forth in TAPPI CA Report No. 40 (1971), page 89. The bagasse can be stored over a period of about 1 to 1.5 years.

The bagasse is reclaimed from the Ritter pile and conveyed to the second wet cleaning stage. Wet depithing is carried out in aqueous suspension in a depithing drum. Since the pith is loosened from the fibers as a result of the storage conditions the pith can be removed without application of mechanical energy. About 70% of the residual pith can be removed by this depithing step. The depithed material is very uniform and of high quality. In view of the requirements of the cooking process, the bagasse is dewatered by a suitable dewatering press. The bagasse transported to the digester should have a content of approximately 30–35% dry solids.

The bagasse is fed to the continuous digester by a feeder in which the pulping chemicals are added simultaneously. Pulping is carried out by the neutral sulfite semi-chemical process. The concentration of cooking chemicals is 160 g./l. $Na_2SO_3$ and 50 g./l.$Na_2CO_3$. Normally, an amount of 14% $Na_2SO_3$ and 4% $Na_2CO_3$ calculated on b.d. bagasse is used. The cooking time is between 20 and 40 minutes at a temperature of 170°–175° C. The pH value ranges between 9 and 9.5. After continuous pulping, the cooked material is subjected to hot defibration in a double disk refiner. The stock is defibrated uniformly and carefully. The residual black liquor is separated and the pulp is subsequently washed and cleaned by means of vibratory and centrifugal screens. Due to the good quality of the raw material, the screening looses are very low. An amount of about 2 ton steam (12 atm.) is used for 1 ton (metric ton) of pulp. The yield calculated on b.d. depithed bagasse amounts to 70–75%.

Mechanical screening carried out at high dilution factor is followed by dewatering with a filter. The pulp of 10–15% solids content is stored in a storage chest, from which it is transported either to a second cleaning stage, if necessary, or to the peroxide bleaching step. The bleaching is carried out at high solids content, from 6 to 12%, at a chemical concentration of about 1.5 $H_2O_2$, 3% NaOH and 3% sodium silicate, calculated on b.d. pulp. The pH value during bleaching is near 11 and the temperature between 50° and 70° C., the retention time 18 min. The amount of steam necessary for bleaching is about 0.5 ton/ton of pulp (metric tons). The increase in brightness is from 45 to 61. After bleaching, the pulp is pumped directly to the paper mill or can be dewatered on a dewatering machine, with a screw press or flat press, or by a vacumm filter. The pulp produced by this process has the following properties:

TABLE 1

| PULP PROPERTIES | | | |
|---|---|---|---|
| SAMPLE | A | B | C |
| Beating Time (minutes) | 5 | 8 | 11 |
| Freeness (°SR) | 33 | 42 | 49 |
| Basis weight (g/m$^2$) | 81 | 80 | 80 |
| Thickness (mm) | 0.123 | 0.115 | 0.112 |
| Density (g/cm$^3$) | 0.66 | 0.70 | 0.71 |
| Breaking load (kp) | 8.7 | 9.7 | 10.3 |
| Tensile (%) | 3.9 | 4.1 | 4.5 |
| Breaking length (km) | 7.13 | 8.05 | 8.62 |
| Tearing strength (cmg/cm) | | | |
| abs. | 135 | 142 | 132 |
| rel. | 166 | 177 | 166 |
| Bursting strength (kp/cm$^2$) | | | |
| abs. | 3.8 | 3.30 | 3.59 |
| rel. | 3.78 | 4.11 | 4.50 |
| Brightness Elrepho Filter R 46 | 61 | | |

Newsprint is made from the pulp of the present invention by formulating pulp furnish as follows:

pulp: 100 parts bagasse pulp filler: 7–10% china clay (calculated on pulp)

alum: 3% (calculated on pulp) methylene blue, methylene violet.

The stock preparation comprises the following steps:

homogenizing in disk refiners addition of papermaking additives:

china clay, blue colour, for compensation of the yellowiwh colouring of the bagasse pulp, alumn;

treatment in Jordan mills (conical refiners) mild beating.

final screening of ready stock hydrocyclones-selectifier. The addition of clay is carried out prior to beating in the Jordan mills, a certain part of the china clay is added within the machine chest after beating and final screening.

Newsprint paper produced from this pulp furnish has the following physical properties:

TABLE 2

Comparison of physical properties of Newsprint paper produced in test runs according to different processes: Values (1) and (2) taken from (TAPPI CA Report, No. 40, S. 137 ff)

| Process / phys. property | Acc. to Inv. | (1) Cusi | (2) Peadco |
|---|---|---|---|
| Addition of chemical long-fibered pulp | 0 | no specifications available | 0 +5% clay |
| Basis weight g/m$^2$ | 52 | 51.3 | 52.0 |
| Density g/cm$^3$ | 0.61 | 0.57 | — |
| Bursting strength kp/cm$^2$ | | | |
| abs. | 1.43 | 1.20 | 0.70 |
| rel. | 2.75 | 2.35 | 1.35 |
| Tearing strength cmp/cm | | | |
| abs. | 43 | 36 | 35 |
| rel. | 83 | 70 | 67 |
| Breaking Load kp | 4.33 | 3.82 | 3.0 |
| Breaking length m | 5550 | 4950 | 3650 |
| Brightness | 61 | 62.0 | 55 |
| Opacity | .92 | 74.5 | 90 |

(1) Test run at San Cristobal.
(2) Test run at Paramonga.

Test methods used in determining the various pulp and paper properties are either German Zellcheming-Standards or US Tappi-Standards.

Aside from being used in newsprint, the bagasse pulp produced by the present invention can be employed in the usual applications of paper pulp according to economic circumstances. Also, the bagasse pulp of this invention can be mixed with other pulps produced by conventional processes in order to produce inexpensive papers of a desired quality.

EXAMPLE 1

Under the conditions shown in Table 3, wet storage of depithed bagasse was effected.

TABLE 3

Effect of the addition of organic substances during moist storage of bagasse

Results of comparative tests

| | additives | | | |
|---|---|---|---|---|
| | bacterial (Ritter-cultures) | Lactic acid | propionic and propionic amide | Control |
| Test material | raw bagasse, partially depithed | | | |
| original moisture content | 52% | 52% | 52% | 52% |
| starting material (kg dry substance) | 50 | 50 | 50 | 50 |
| storage time (3 months) | Apr.–June | Apr.–June | Apr.–June | Apr.–June |
| liquid added*(m$^3$) | 2.5 | 2.5 | 2.5 | none |
| additions | Ritter cultures | lactic acid (125 g) sodium lactate (125 g) | propionic acid (125 g) propionic amide (125 g) | none |
| final dry content | 26% | 28% | 28% | 65% |
| dry material (kg) after storage | 48.2 | 48.4 | 48.3 | 40.5 |
| storage losses (%) | 3.6 | 3.2 | 3.4 | 19.0 |
| colour | pale brown | pale brown | pale brown | deep brown to green |

*the liquid was water

As can be seen, unexpectedly the results achieved with lactic acid/sodium lactate and with propionic acid/propionic amide are fully equivalent to those conventionally achieved using Ritter cultures.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for the production of paper pulp from sugar mill bagasse comprising:
   (a) moist depithing raw sugar mill bagasse to remove up to about 66% of the pith content and leave residual pith;
   (b) wet bulk storing said partially depithed bagasse;
   (c) forming a aqueous suspension of the stored, partially depithed bagasse;
   (d) wet depithing the formed aqueous suspension of the stored, partially depithed bagasse by hydraulic shearing thereof while simultaneously adding 0.5–10 parts per 100 parts of suspension of a carbonate, sulfite, hydroxide, phosphate, polyphosphate, chlorite or hypochlorite of an alkali metal, magnesium, calcium or aluminum;
   (e) pulping the wet depithed bagasse of step (d) by a neutral sulfite semi-chemical process or thermomechanical defibration;
   (f) mechanically pulping the product of step (e); and
   (g) washing, screening, cleaning and dewatering the pulp produced in step (f).

2. The process of claim 1, which further comprises (h) bleaching the pulp of step (g).

3. The process of claim 2, wherein from 33 to 66% of the pith is removed in step (a); whereafter
   up to 80% of the residual pith remaining after step (b) is removed from the aqueous suspension of stored partially depithed bagasse in step (d);
   pulping is by the neutral sulfite semi-chemical process using sodium carbonate buffer at 140°–185° C. for 2–60 minutes; and
   bleaching is performed in a medium containing about 1–5 wt. % of $H_2O_2$, 1–5 wt. % of NaOH and 1–5 wt. % of sodium silicate.

4. The process of claim 1 further comprising treating the partially depithed bagasse in wet bulk storage with a preservative, selected from the group consisting of (a) a $C_{1-5}$ aliphatic acid; (b) a $C_{1-5}$ aliphatic acid substituted by amino or halogen; (c) a $C_{1-6}$ hydroxy acid; (d) an alkali metal, Al or aluminum phosphate salt of (a), (b) or (c); and (e) an amide of (a), (b) or (c), to preserve the partially depithed bagasse.

5. The process of claim 4, wherein said preservative is lactic acid, sodium lactate, propionic acid or propionic amide.

6. The process of claim 4, wherein there is added 0.01–0.3 g per liter of storage volume of said preservative added during wet bulk storage.

7. The process of claim 4, wherein said preservative is monosodium maleinate, disodium citrate or aluminum monoacetate phosphate.

8. In a process for the production of paper pulp from sugar mill bagasse which comprises wet bulk storing partially depithed bagasse, the improvement which comprises treating the partially depithed bagasse in wet bulk storage with an amount of a carbonate, phosphate, polyphosphate, sulfite, chlorite or hypochlorite of an alkali metal, magnesium, calcium or aluminum effective to preserve the partially depithed bagasse, and further treating the partially depithed bagasse in wet bulk storage with a second preservative, selected from the group consisting of an amount of (a) a $C_{1-5}$ aliphatic acid; (b) a $C_{1-5}$ aliphatic acid substituted by amino or halogen; (c) a $C_{1-6}$ hydroxy acid; (d) an alkali metal, Al or aluminum phosphate salt of (a), (b) or (c); and (e) an amide of (a), (b) or (c), to preserve the partially depithed bagasse.

9. The process of claim 8, wherein the second preservative is lactic acid, sodium lactate, propionic acid or propionic amide.

10. The process of claim 4 or 8 which further comprises treating partially depithed bagasse wet bulk storage with an acid-producing bacterial culture.

11. The process of claim 8, wherein there is added 0.01–0.3 g per liter of storage volume of said second preservative during wet bulk storage.

12. The process of claim 8, wherein said second preservative is monosodium maleinate, disodium citrate or aluminum monoacetate phosphate.

13. The process of claim 8 wherein the process for the production of paper pulp comprises:
   (a) moist depithing raw sugar mill bagasse to remove up to about 66% of the pith content and leave residual pith;
   (b) wet bulk storing said partially depithed bagasse;
   (c) forming an aqueous suspension of the stored, partially depithed bagasse;
   (d) wet depithing the formed aqueous suspension of the stored, partially depithed bagasse by hydraulic shearing;
   (e) pulping the wet depithed bagasse of step (d) by a neutral sulfite semi-chemical process or thermomehanical defibration;
   (f) mechanically pulping the product of step (e); and
   (g) washing, screening, cleaning and dewatering the pulp produced in step (f).

14. The process of claim 13, which further comprises (h) bleaching the pulp of step (g).

15. The process of claim 8 wherein the amount of said carbonate, phosphate, polyphosphate sulfite, chlorite or hypochlorite of the alkali metal, magnesium, calcium or aluminum is 1.0–20 g per liter of storage volume.

* * * * *